US009127550B2

(12) United States Patent
Hunt et al.

(10) Patent No.: US 9,127,550 B2
(45) Date of Patent: Sep. 8, 2015

(54) TURBINE SUPERALLOY COMPONENT DEFECT REPAIR WITH LOW-TEMPERATURE CURING RESIN

(75) Inventors: David W. Hunt, Orlando, FL (US); David B. Allen, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 300 days.

(21) Appl. No.: 13/571,678

(22) Filed: Aug. 10, 2012

(65) Prior Publication Data

US 2014/0044939 A1 Feb. 13, 2014

(51) Int. Cl.
*F01D 5/00* (2006.01)

(52) U.S. Cl.
CPC ..... *F01D 5/005* (2013.01); *F05D 2230/80* (2013.01); *F05D 2300/175* (2013.01); *F05D 2300/44* (2013.01); *Y10T 428/24802* (2015.01); *Y10T 428/24926* (2015.01)

(58) Field of Classification Search
USPC ..... 428/621; 416/241 R
See application file for complete search history.

(56) References Cited

U.S. PATENT DOCUMENTS

| | | | | |
|---|---|---|---|---|
| 5,726,348 | A * | 3/1998 | Draghi et al. | 73/37 |
| 5,806,751 | A * | 9/1998 | Schaefer et al. | 228/119 |
| 7,115,679 | B2 | 10/2006 | Ellison et al. | |
| 7,546,683 | B2 * | 6/2009 | Hazel et al. | 29/889.1 |
| 7,749,569 | B2 * | 7/2010 | Wilkins et al. | 427/372.2 |
| 7,789,288 | B1 * | 9/2010 | Johnson et al. | 228/119 |
| 2001/0054473 | A1 * | 12/2001 | Chou et al. | 156/94 |
| 2005/0224474 | A1 * | 10/2005 | Kilburn | 219/121.68 |
| 2007/0207328 | A1 * | 9/2007 | Frost et al. | 428/469 |
| 2008/0213617 | A1 * | 9/2008 | Taylor et al. | 428/603 |
| 2009/0000101 | A1 * | 1/2009 | Reynolds et al. | 29/402.11 |
| 2009/0324841 | A1 | 12/2009 | Arrell et al. | |
| 2011/0059321 | A1 * | 3/2011 | Skoog et al. | 428/446 |

OTHER PUBLICATIONS

Cotronics Corp literature on Thermeez, Durabond, Duralco. No date.*

TechBulletin—Pyromax1.

High Temperature Ceramic-Metallic Pastes, Technical Bulletin A3, Rev. 6-12.

* cited by examiner

*Primary Examiner* — Archene Turner

(57) ABSTRACT

Voids, cracks or other similar defects in substrates of thermal barrier coated superalloy components, such as turbine blades or vanes, are filled with resin, without need to remove substrate material surrounding the void by grinding or other processes. The resin is cured at a temperature under 200° C., eliminating the need for post void-filling heat treatment. The void-filled substrate and resin are then coated with a thermal barrier coating.

5 Claims, 2 Drawing Sheets

TURBINE SUPERALLOY COMPONENT DEFECT REPAIR WITH LOW-TEMPERATURE CURING RESIN

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

BACKGROUND OF THE DISCLOSURE

1. Field of the Invention

The invention relates to methods for cosmetic, non-structural repair of voids or defects in turbine superalloy components, such as turbine blades and vanes, including service-degraded components. More particularly, the present invention relates to cosmetic, non-structural repair of voids or defects, including cracks, in thermal barrier coated gas turbine blades and vanes with low temperature hardening resins to restore component dimensions at the defect site prior to their recoating with a new thermal barrier coating.

2. Description of the Prior Art

Repair or new fabrication of nickel and cobalt based superalloy material that is used to manufacture turbine components, such as cast turbine blades, is challenging, due to the metallurgic properties of the finished blade material. For example a superalloy having more than 6% aggregate aluminum or titanium content, such as CM247 alloy, is more susceptible to strain age cracking when subjected to high-temperature welding than a lower aluminum-titanium content X-750 superalloy. The finished turbine blade alloys are typically strengthened during post casting heat treatments, which render them difficult to perform subsequent repair. Currently used repair processes for superalloy turbine components by welding or brazing generally require substantial component heating. When a blade constructed of such a material is welded with filler of the same or similar alloy, the blade is susceptible to solidification (aka liquation) cracking within and proximate to the weld, and/or strain age (aka reheat) cracking during subsequent heat treatment processes intended to restore the superalloy original strength and other material properties comparable to a new component.

Non-structural repair or fabrication of metals, including superalloys, is recognized as replacing damaged material with mismatched alloy material of lesser structural property specifications, where the localized original structural performance of the original substrate material is not needed. For example, non-structural or cosmetic repair may be used in order to restore the repaired component's original profile geometry. In the gas turbine repair field an example of cosmetic repair is for filling surface pits, cracks or other voids on a turbine blade airfoil in order to restore its original aerodynamic profile, where the blade's localized exterior surface is not critical for structural integrity of the entire blade. Cosmetic repair or fabrication is often achieved by removing the existing void or defect by grinding or other similar processes to expose fresh unblemished substrate and then filling the ground-out substrate material using oxidation resistant weld or braze alloys of lower strength than the blade body superalloy substrate, but having higher ductility and lower application temperature that does not negatively impact the superalloy substrate's material properties. Grinding out the void or other defect reduces the volume of high-strength superalloy material at the defect site, and merely restores the substrate external profile dimensions by replacement with weaker material.

Diffusion brazing has been utilized to join superalloy components for repair or fabrication by interposing brazing alloy between their abutting surfaces to be joined and heating those components in a furnace (often isolated from ambient air under vacuum or within an inert atmosphere) until the brazing alloy liquefies and diffuses within the substrate of the now-conjoined components. Diffusion brazing can also be used to fill surface defects, such as cracks, in superalloy components by inserting brazing alloy into the defect and heating the component in a furnace to liquefy the brazing alloy and thus fill the crack. In some types of repairs a torch, rather than a furnace can be used as a localized heat source to melt the brazing alloy.

When performing diffusion or torch brazing on superalloy components care must be taken to avoid overheating the substrate and causing its structural degradation, as discussed above. To this end, brazing alloys with relatively low melting points have been used to minimize heating of the overall superalloy substrate. Low melting point brazing alloys often include silicon (Si), boron (B) and/or phosphorous (P) that do not promote good bonding of thermal barrier coating when the brazed blades are recoated for service use.

Superalloy turbine blade and vane braze repair requires expensive and time-consuming braze alloy application as well as post-brazing heat treatment. Those post-repair heat treatment processes risk thermal degradation of the blades or vanes and scrapping of components that are not successfully repaired, wasting all prior repair efforts. Thus for economic reasons, the total repair expense and risk of unsatisfactory blade and vane repair leads to discarding of components where ultimate repair success is questionable. Additionally, as previously noted, current braze repair processes remove strong superalloy substrate material around the repair site and replaces it with structurally weaker material. Effort and expense are undertaken to remove substrate material at the repair site, at least conceptually weakening the remaining substrate. Subsequent post-brazing heat treatment further risks weakening the repaired superalloy component.

Thus, a need exists in the art for a for a method for performing cosmetic repairs on surfaces of superalloy components such as turbine vanes and blades, so that voids, cracks and other surface defects can be repaired, without degrading structural properties of the component substrate.

Another need exists in the art for a method for performing repairs on surfaces of superalloy components, such as turbine vanes and blades, with proven, repeatable repair techniques and repair equipment that do not require removal of substrate material at the repair site, brazing, or post-repair heat treatment procedures that might also degrade structural properties of the component substrate.

Yet another need exists in the art for a method for performing repairs on surfaces of superalloy components, such as turbine vanes and blades, at lower cost, relatively short repair cycle times and higher likely repair success, in order to reduce component repair "fallout" failure and increase the number of components that can be repaired without scrapping them.

SUMMARY OF THE INVENTION

Accordingly, an object of the invention is perform cosmetic repairs on surfaces of superalloy components such as turbine vanes and blades, so that voids, cracks and other surface defects can be repaired, without degrading structural properties of the component substrate.

Another object of the invention is to perform repairs on surfaces of superalloy components, such as turbine vanes and blades, with proven, repeatable repair techniques and repair equipment that do not require removal of substrate material at the repair site, brazing, or post-repair heat treatment procedures that might also degrade structural properties of the component substrate.

Yet another object of the invention is to perform repairs on surfaces of superalloy components, such as turbine vanes and blades, at lower cost, relatively short repair cycle times and higher likely repair success, in order to reduce component repair "fallout" failure and increase the number of components that can be repaired without scrapping them.

These and other objects are achieved in accordance with the present invention by a method for fabricating or repairing a thermal barrier coated superalloy component, such as for example a turbine blade or vane, which has a substrate that has a void or other defect, such as a crack, by filling the void with particle filled resin without need to remove substrate material surrounding the void by grinding or other processes. The resin may be air dried at room temperature and subsequently heat cured at a temperature under 200° C., preferably under 150° C., eliminating the need for post void-filling heat treatment. The void-filled substrate and resin are then coated with a metallic coating, commonly termed a bondcoat, followed by a ceramic thermal barrier coating. Thus, the resin-filled crack or other defect restores surface profile of the substrate surrounding the defect and facilitates better thermal barrier coating adhesion than known low melting point brazes that contain boron, silicon or phosphorous. Those elements in brazing alloys do not promote good thermal barrier coating adhesion.

An embodiment of the present invention features a turbine component including a superalloy substrate surface having a void. Particle-filled resin, curable under 200 degrees Celsius temperature fills the void. The component has a metallic bondcoat and a thermal barrier coating on the substrate surface and resin.

Another embodiment of the present invention features a method for fabricating a thermal barrier coated superalloy component by providing a superalloy component substrate having a void; filling the substrate void with particle-filled resin; curing the resin under 200 degrees Celsius; and coating the substrate and resin with a thermal barrier coating.

Yet another embodiment of the present invention features a method for repairing a service-degraded turbine superalloy component, by stripping coating off a component substrate and exposing a defect in the substrate. The defect is left in the substrate and not removed by removing surrounding substrate material. The defect is filled with particle-filled resin and cured at a temperature under 150 degrees Celsius. The cured resin is shaped, such as by known grinding techniques, to conform it to substrate surface dimensions surrounding the defect. A thermal barrier coating is applied to the substrate and resin.

The objects and features of the present invention may be applied jointly or severally in any combination or sub-combination by those skilled in the art.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of my invention can be readily utilized in fabrication and repair of superalloy components, including for example turbine blades and vanes. Voids and defects, such as cracks, are filled with a low-temperature hardening resin that cures at a temperature less than 200° C., and preferably less than 150° C., without undertaking effort to remove surrounding substrate material that might otherwise structurally weaken the component. The defect or void does not have to be filled with hot braze alloy, reducing effort and cost of repair, as well as reducing likelihood of causing thermal damage to the blade during the brazing process and subsequent heat treatment. When practicing the defect repair methods of the present invention, post defect-filling heat treatment is not required. The component substrate and filler resin are subsequently covered with a thermal barrier coating using known coating application methods. Those methods may include, for example, grinding or otherwise conforming hardened resin filler outer surface to dimensions of the surrounding substrate for a smooth, continuous repaired surface. The substrate and hardened resin may be grit blasted and/or bond coated prior to application of the thermal barrier coating.

Figure 1:
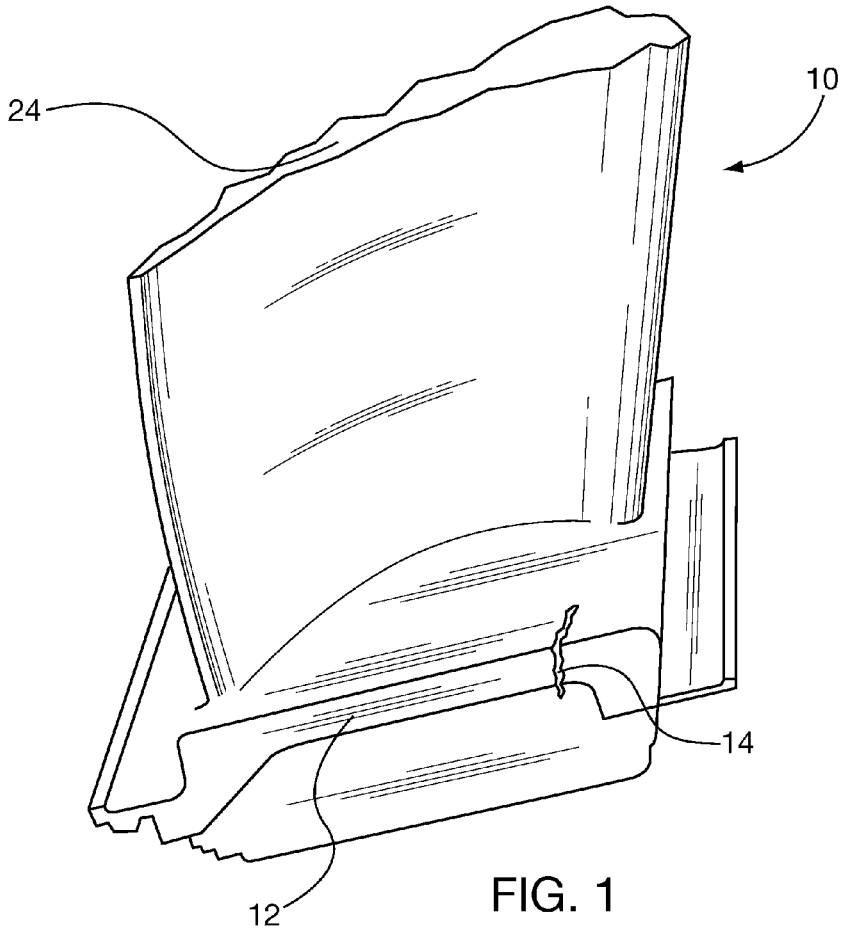
FIG. 1 shows a schematic elevational perspective view of a superalloy turbine blade component having a crack defect void.

FIG. 1 shows a known exemplary thermal barrier coated industrial gas turbine superalloy blade 10 having a blade root substrate 12 with a surface void or defect crack 14 that is a candidate for cosmetic repair, rather than structural repair. The goal of cosmetic repair is to restore a continuous surface in the defect zone within the blade's dimensional specifications. The blade 10 is prepared for repair by stripping existing thermal barrier and other coatings, combustion contamination, etc. by known processes, leaving a clean substrate 12. The crack defect is cleaned, but does not have to be excised from the substrate by grinding or other known metal removal methods, as is customarily done when performing brazing repairs. If the blade 10 has a defect within a previously brazed repair zone, the defect may be repaired with the methods of the present invention without removing the braze material.

Figure 2:
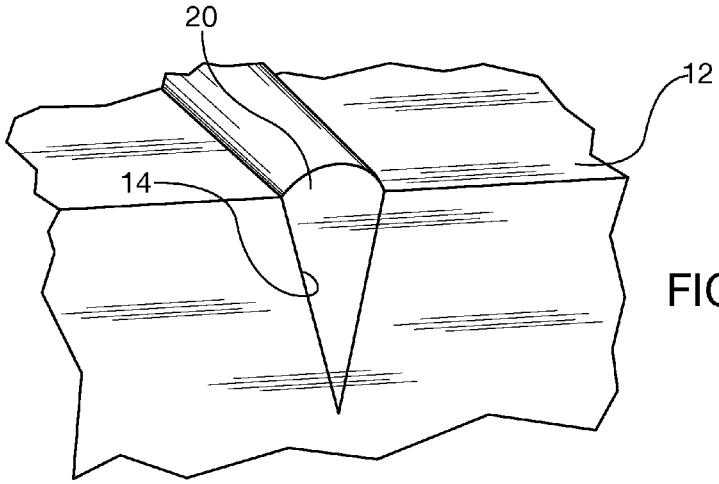
FIG. 2 shows an enlarged perspective view of the turbine blade defect of FIG. 1 filled with resin, in accordance with an embodiment of the present invention.
Figure 3:
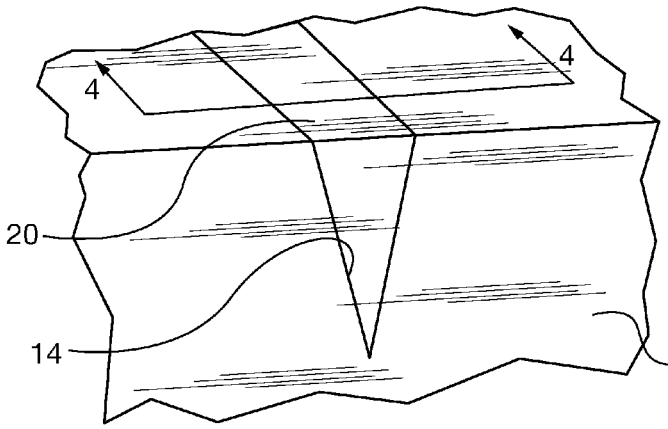
FIG. 3 shows an enlarged view of the turbine blade defect of FIG. 1, where the resin has been ground to conform it to the dimensional profile of the surrounding turbine blade substrate, in accordance with an embodiment of the present invention.

In FIG. 2, the crack defect 14 within the turbine blade substrate 12 is filled with a hardening resin filler 20, again without the need to remove the crack defect from the substrate. Filler 20 can be applied with hand tools at ambient temperature and intentionally projects, or is "proud" of the substrate surface. After the filler 20 cures, it is ground flush with the substrate as shown in FIG. 3. In this way the filler 20 surface conforms with the surrounding substrate 20 dimensions and restores the repaired blade to dimensional specifications. When applied to the blade substrate 12, the filler 20 is a pliable particle-filled resin putty or two-part epoxy-like viscous material that chemically and/or mechanically bonds with interstices within the crack 14.

The filler 20 composition comprises ceramic and/or metallic particles, and preferably both ceramic and metallic filler particles mixed in organic and/or inorganic resin, that upon resin hardening adds structural strength to the filler. The filler 20 is commercially known and available low-temperature hardening, high-temperature resistant putty customarily used to seal joints and repair defects in vehicle exhaust system manifolds, boilers, furnaces and the like. The commercially-available fillers include particle combinations of ceramic, aluminum, stainless steel, iron oxide, that are temperature resistant up to approximate 1100° C. (2000° F.), and are capable of curing at temperatures below 200° C. (400° F.). Some commercially available fillers cure at temperatures below 100° C. (212° F.) and some at ambient air temperature. These relatively low curing temperatures are well below temperatures that cause thermal degredation of superalloy substrates.

The low-temperature curing filler 20 eliminate the time and expense attendant in post-repair heat treatment necessary for known brazing repair methods, as well as risks of component blade 10 thermal degredation caused by the heat treatment process itself. The low repair cost and efforts for filling defects 14 in superalloy components makes more components potential candidates for repair, with greater likelihood of repair success. Thus fewer superalloy components repaired with the present invention methods need to be scrapped without attempting any repair during repair (so-called "repair fallout").

Figure 4:
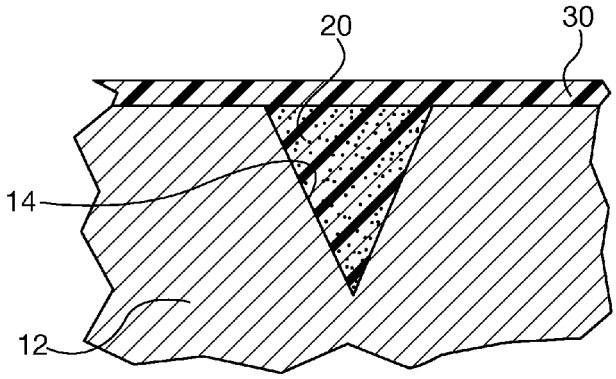
FIG. 4 is an elevational cross-sectional view taken along 4-4 of FIG. 3, showing a thermal barrier coating applied to the substrate and resin.

After filler 20 curing and shaping to conform to the surrounding substrate 12 dimensional specifications the blade 10 or other superalloy component is prepared for application of a metallic bondcoat and thermal barrier coating using presently known methods. For example, the repaired blade 10, including the now filled defect 14 may be grit blasted prior to application of the bond coating and thermal barrier coating layer. An exemplary repaired turbine blade 10 is shown in FIG. 4, with a bond coating/thermal barrier coating 30 covering the substrate 12, defect 14, and the cured filler material 20. The cured filler material 20 may also cover existing braze material on the substrate 12 (not shown) for better adhesion of bond coating and the thermal barrier coating 30. As previously discussed, braze material often contains elements such as boron, phosphorous and/or silicon that do not promote bond coat or thermal barrier coating adhesion.

Although various embodiments which incorporate the teachings of the present invention have been shown and described in detail herein, those skilled in the art can readily devise many other varied embodiments that still incorporate these teachings.

What is claimed is:

1. A turbine superalloy component, comprising:

a superalloy material turbine vane or blade temperature, resistant up to approximately 1100 degrees Celsius temperature, with a substrate surface having a void;

particle-filled, hardened and cured resin layer filling the void, the resin curable under 200 degrees Celsius temperature, and temperature resistant up to approximately 1100 degrees Celsius temperature;

a bond coat layer on the substrate surface and resin layer; and a thermal barrier coating on the bond coat and resin layer;

sequential layers of the respective resin, bond coat, and thermal barrier coating remaining intact when exposed to turbine operating temperature up to approximately 1100 degrees Celsius.

2. The component of claim 1, comprising an industrial gas turbine engine turbine section blade or vane.

3. The component of claim 1, the resin selected from the group consisting of metallic-filled resin and ceramic-filled resin.

4. The component of claim 1, the resin comprising metallic and ceramic-filled resin.

5. The component of claim 1, the void comprising a surface defect remaining in the substrate filled with the resin.

* * * * *